US007513010B2

(12) United States Patent
Duan et al.

(10) Patent No.: US 7,513,010 B2
(45) Date of Patent: Apr. 7, 2009

(54) AUTOMATIC OPENING HINGE ASSEMBLY FOR PORTABLE ELECTRONIC DEVICE

(75) Inventors: Chao Duan, Shenzhen (CN); Chia-Hua Chen, Tu-Cheng (TW)

(73) Assignees: Shenzhen Futaihong Precision Industry Co., Ltd., ShenZhen, Guangdong Province (CN); Sutech Trading Limited, Tortola (VG)

( * ) Notice: Subject to any disclaimer, the term of this patent is extended or adjusted under 35 U.S.C. 154(b) by 473 days.

(21) Appl. No.: 11/384,462

(22) Filed: Mar. 20, 2006

(65) Prior Publication Data

US 2006/0254026 A1 Nov. 16, 2006

(30) Foreign Application Priority Data

May 13, 2005 (CN) ..... 200510034656

(51) Int. Cl.
*E05D 11/10* (2006.01)

(52) U.S. Cl. ..... 16/330; 16/303

(58) Field of Classification Search ..... 16/337–339, 16/342, 330, 303, 374, 376, 377, 340; 361/680–683, 361/814; 455/90.3, 575.1, 575.3, 575.8; 379/433.12, 433.13; 348/373, 333.01, 333.06, 348/794

See application file for complete search history.

(56) References Cited

U.S. PATENT DOCUMENTS

| | | | | |
|---|---|---|---|---|
| 6,148,480 | A * | 11/2000 | Cooke | 16/303 |
| 7,007,345 | B2 * | 3/2006 | Nakase et al. | 16/330 |
| 7,100,239 | B2 * | 9/2006 | Duan et al. | 16/303 |
| 7,117,563 | B2 * | 10/2006 | Chen et al. | 16/330 |
| 2005/0188503 | A1 * | 9/2005 | Duan et al. | 16/303 |
| 2006/0032020 | A1 * | 2/2006 | Duan et al. | 16/288 |

* cited by examiner

*Primary Examiner*—Chuck Y. Mah
(74) *Attorney, Agent, or Firm*—Steven M. Reiss

(57) ABSTRACT

A hinge assembly (200) includes a retaining member (4), a fixing seat (5), a control member (6), a first spring (7), a follower element (10), a rotating element (20), a second spring (9) and a shaft (30). The first spring provides an elastic force to the control member. The rotating element includes an axis hole having an inner screw thread (4342). The rotating element disposes two protrusions (24). The follower element includes two recesses (15) and two plane portions (16). The second spring provides an elastic force to make the protrusions of the rotating element receive in the recesses of the follower element and resist each other. The shaft defines an outer screw thread (233). The outer screw thread engages with the inner screw thread of the rotating element.

17 Claims, 4 Drawing Sheets

AUTOMATIC OPENING HINGE ASSEMBLY FOR PORTABLE ELECTRONIC DEVICE

CROSS-REFERENCE TO RELATED APPLICATIONS

This application is related to two co-pending U.S. patent application Ser. Nos. 11/384,471 and 11/384,472, both entitled "AUTOMATIC OPENING HINGE ASSEMBLY FOR FOLDABLE ELECTRONIC DEVICES", by Chao Duan et al. Such applications have the same assignee as the instant application and have been concurrently filed herewith. The disclosure of the above identified applications is incorporated herein by reference.

BACKGROUND OF THE INVENTION

1. Field of the Invention

The present invention relates to hinge assemblies and, particularly, to an automatic opening hinge assembly for foldable devices such as portable telephones, portable computers, and so on.

2. Discussion of the Related Art

With the development of wireless communication and information processing technologies, foldable electronic devices such as mobile phones and PDAs (Personal Digital Assistants) are now in widespread use, and consumers may now enjoy the full convenience of high technology products anytime and anywhere. Foldable electronic devices are particularly favoured by a wide range of consumers because of their small size, novel design and ease of use. Use of a foldable design can also avoid accidental activation of keys/buttons of the electronic device during transportation/storage.

The foldable mobile telephone generally includes a cover section and a body section. The cover section and the body section are rotatably interconnected through a hinge assembly, thus allowing the telephone to be switched between an in-use position and a closed position. One kind of hinge assembly employs a cam and a follower, which makes the cover section fold outward from the body section and then hold in an open position. The hinge assembly typically includes a cam having a concave portion, a follower having a convex portion, a shaft having a fixing end, and a spring. The cam and the follower are placed around the shaft. The spring resists the follower to make the concave portion tightly contact the convex portion. The cam, the follower, the shaft and the spring are received in a housing. A flip cover rotates about a main body of the mobile phone by overcoming the force of the spring, thus making the concave portion rotate about the convex portion.

However, a user must open the mobile phone using both hands. This makes the mobile phone awkward to utilize in situations when the user has only one hand free. In addition, the foldable electronic device can only be opened to preset angles, because the cam only stably engages with the coplanar end faces of follower in a few preset positions. In addition, the concave portion of the cam is designed with relatively sharp edges and corners, which are prone to being worn smooth by repeated use. When this happens, the connection between the body and the cover is liable to become loose.

Therefore, a new hinge mechanism is desired in order to overcome the above-described shortcoming.

SUMMARY OF THE INVENTION

One embodiment of the present hinge assembly includes a fixing seat, a control member, a first spring, a follower element, a rotating element, a second spring and a shaft. The fixing seat has at least one block. The control member has at least one receiving groove. The at least one block portion is received in the at least one receiving groove. The first spring provides an elastic force to the control member. The rotating element includes a rotating element hole having an inner circumferential wall. The inner circumferential wall defines an inner screw thread. The second spring provides an elastic force to make the rotating element and the follower element resist each other. The shaft defines an outer screw thread. The outer screw thread engages with the inner screw thread of the rotating element. Wherein either the rotating element or the follower element includes a pair of protrusions, the other end of the rotating element or the follower element has a pair of recesses. Each protrusion is releasably received in a corresponding one of the recesses.

Other advantages and novel features of the present hinge assembly will become more apparent from the following detailed description thereof when taken in conjunction with the accompanying drawings.

BRIEF DESCRIPTION OF THE DRAWINGS

Many aspects of the hinge assembly can be better understood with reference to the following drawings. The components in the drawings are not necessarily drawn to scale, the emphasis instead being placed upon clearly illustrating the principles of the present hinge assembly. Moreover, in the drawings, like reference numerals designate corresponding parts throughout the several views.

DETAILED DESCRIPTION OF THE INVENTION

Figure 1:
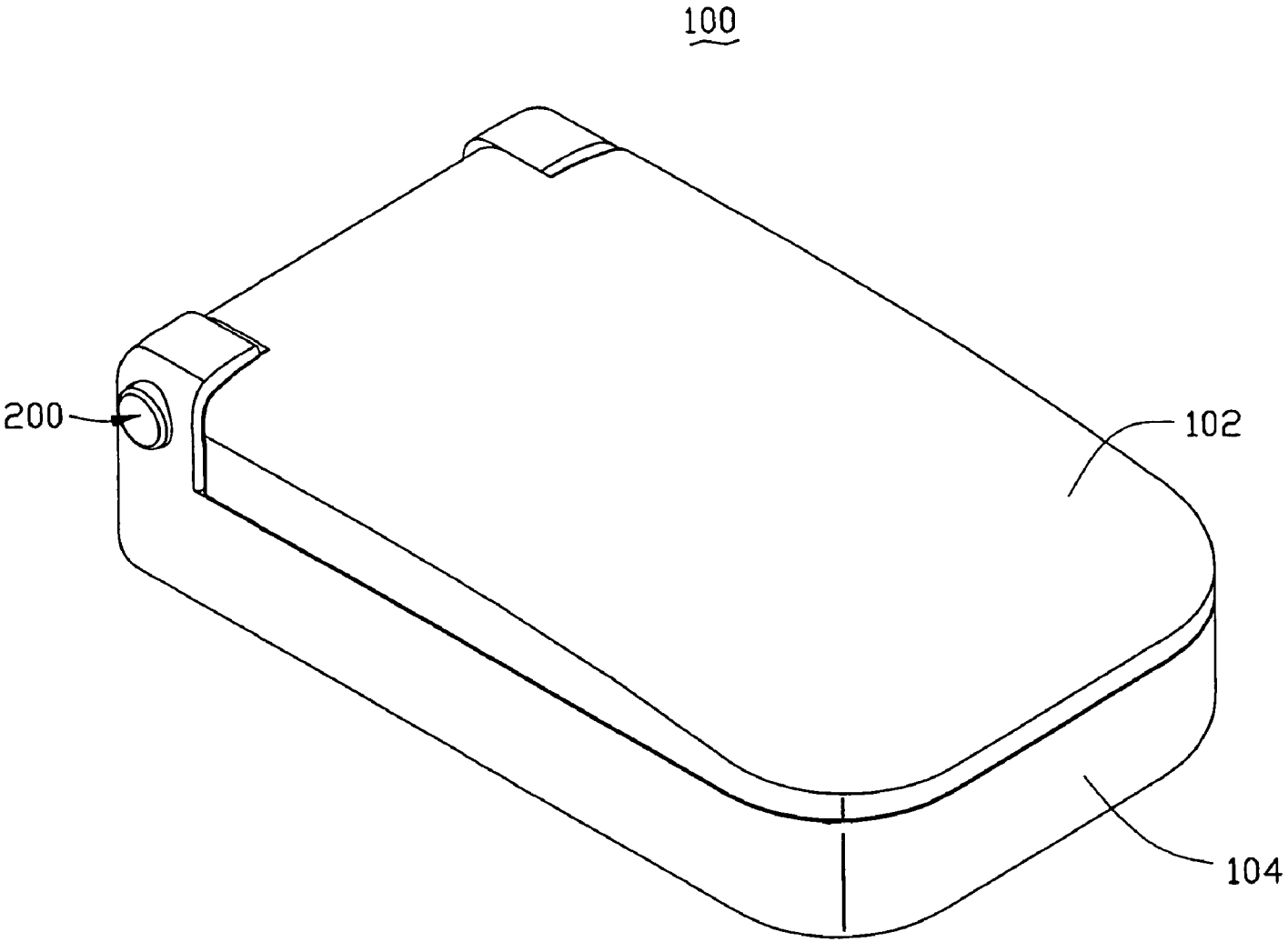
FIG. 1 is an isometric view of an embodiment of the present hinge assembly, as used in a mobile phone.

Referring now to the drawings in detail, FIG. 1 shows a hinge assembly 200, applied to a portable electronic device 100 such as a flip type mobile phone, for pivotably coupling a cover section 102 and a body section 104. It is to be understood, however, that the hinge assembly 200 could be advantageously used in other environments (e.g. cabinet doors). As such, although proving particularly advantageous when used in foldable electronic devices, the hinge assembly 200 should not be considered limited in scope solely to them.

Figure 2:
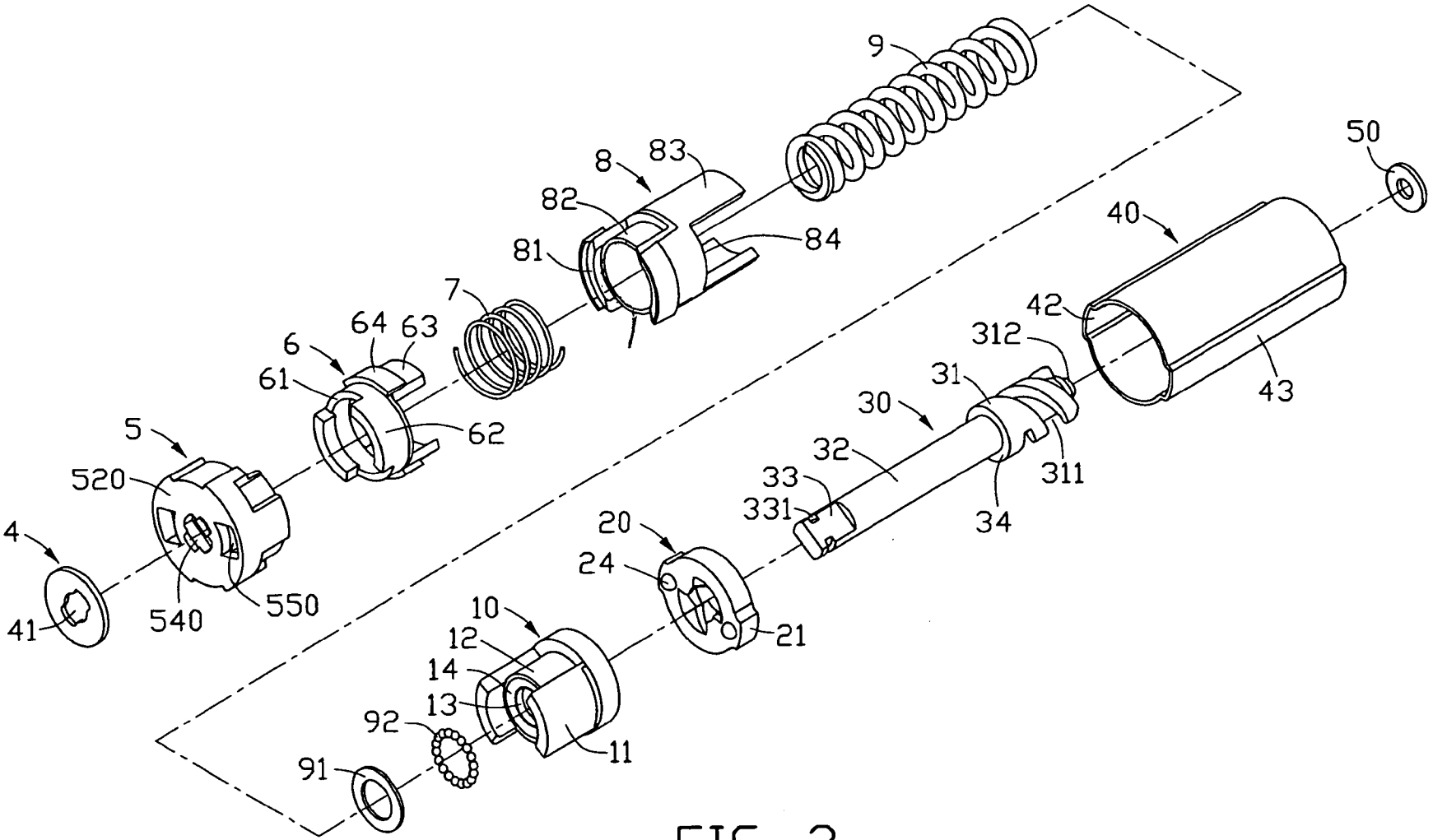
FIG. 2 is an exploded, isometric view of the embodiment of the hinge assembly shown in FIG. 1.
Figure 3:
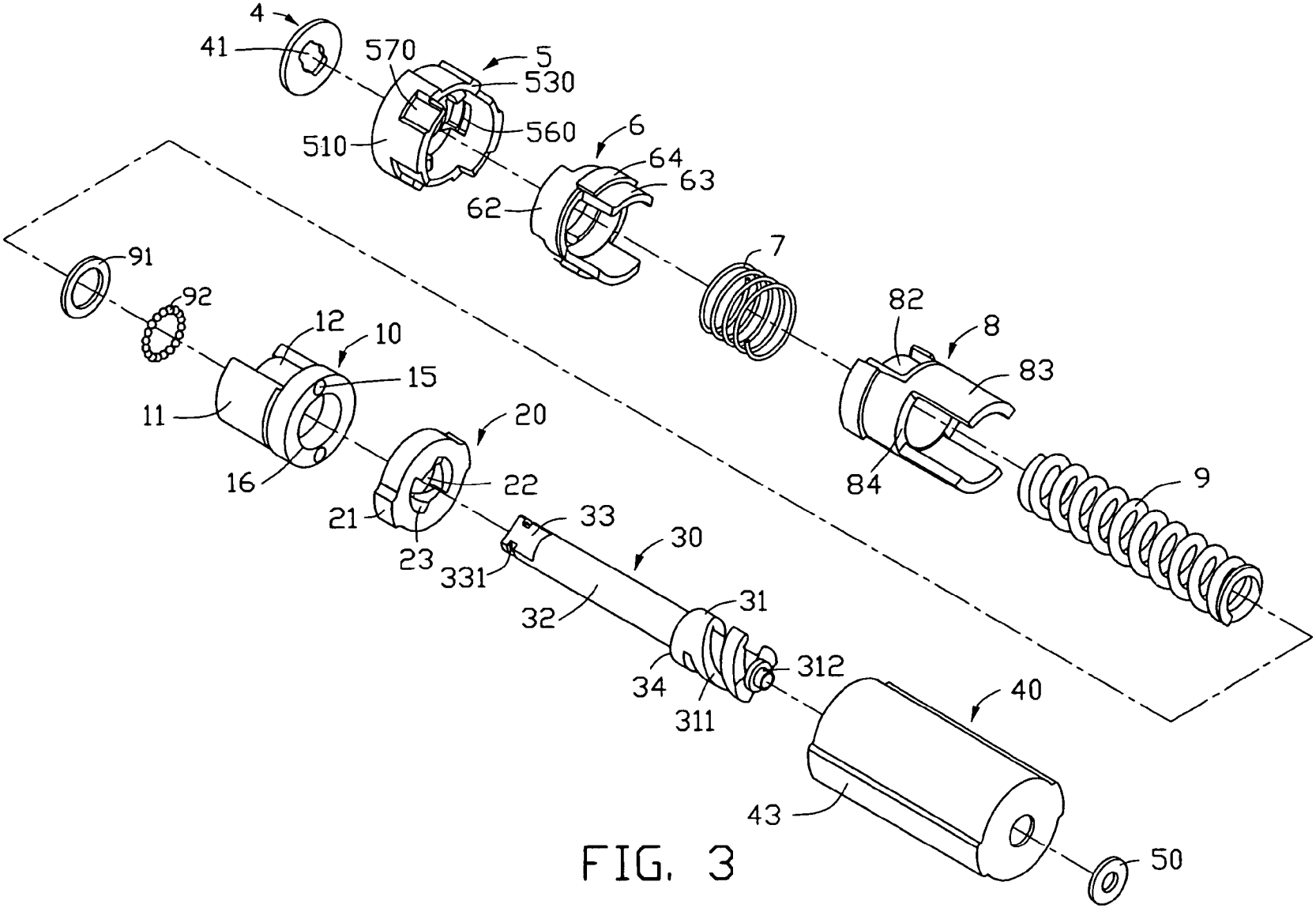
FIG. 3 is similar to FIG. 2, but viewed from another aspect.

Referring to FIGS. 2 and 3, the hinge assembly 200, in one illustrated embodiment, includes a fixing element 4, a fixing seat 5, a control member 6, a first spring 7, a locking member 8, a second spring 9, a ring 91, a set of rolling elements 92, a follower element 10, a rotating element 20, a shaft 30, a sleeve 40 and a washer 50. The fixing element 4, the fixing seat 5, the control member 6, the first spring 7, the locking member 8, the second spring 9, a set of rolling elements 92, the ring 91 and the follower element 10 are placed, in that order, to cooperatively surround the shaft 30 from one end thereof. The rotating element 20 is placed to surround an opposite end of the shaft 30, adjacent to the follower element 10. The sleeve 40 receives and surrounds the above elements. The washer 50 is fixed in the opposite end of the shaft 30. The hinge assembly 200 is thus integrated into a whole.

The fixing element 4 is substantially disk-shaped. The fixing element 4 has a deformed hole 41 defined in a central area thereof.

The fixing seat 5 is substantially cylindrical in shape, and includes an open end and an opposite closed end. The fixing seat 5 has an outside circumferential wall 510 and a bottom wall 520 connected with the outside circumferential wall 510. The outside circumferential wall 510 has two symmetrical openings 530 defined at the open end thereof. The bottom wall 520 has an axis hole 540 defined in a central area thereof. Two symmetrical slots 550 are defined in the bottom wall 520 adjacent to the axis hole 540, and the claws 31 of the button 3 are received in the slots 550. The bottom wall 520 has two blocks 560 extending from the closed end toward the open end thereof. The blocks 560 are adjacent to the two slots 550 and abut against the outside circumferential wall 510. Several reversing grooves 570 are defined in the outside circumferential wall 510, so that the fixing seat 5 can be fixedly retained in the body section 104 of the foldable electronic device 100.

The control member 6 has a cylindrical body, with two receiving grooves 61 defined on opposite sides, and two opposing latching walls 62 formed at one end thereof. The blocks 560 of the fixing seat 5 are for engaging in the receiving grooves 61 and the latching walls 62 are locked between the blocks 560, thereby locking the control member 6 and the fixing seat 5 together. The control member 6 has two opposing protruding posts 63 extending from an opposite end to that of the latching walls 62. Two ribs 64 are formed on an outer periphery of the protruding posts 63. The ribs 64 are received into the openings 530 of the fixing seat 5 so that the latching wall 62 may be engaged between the blocks 560 of the fixing seat 5. An inner diameter of the latching wall 62 is smaller than that of the cylindrical body of the control member 6.

The first spring 7 is a cylinder-shaped spring. A diameter of the first spring 7 is approximately the same as that of the cylinder body of the control member 6, while the diameter of the first spring 7 is larger than the inner diameter of the latching walls 62, thereby one end of the first spring 7 resisting the latching wall 62 of the control member 6 at one end.

The locking member 8 is a substantially hollow cylinder in shape, and has two opposite stepped walls 81 disposed in a circumferential wall thereof. Two latching grooves 82 are defined between the stepped walls 81. The protruding posts 63 of the control member 6 may be locked into the latching grooves 82 so that the control member 6 is fixed with the locking member 8. An inner diameter of the stepped walls 81 is smaller than that of the first spring 7, and an outer diameter of the stepped walls 81 is larger than that of the first spring 7, thereby an opposite end of the first spring 7 to the one resisting the latching wall 62 resists the stepped wall 81 of the locking member 8. The locking member 8 has two extending walls 83 opposite to the stepped wall 81. Thus, two recesses 84 are formed between the extending walls 83.

The second spring 9 is substantially a cylinder (i.e. occupying a cylindrical volume). The spring 9 is placed around the shaft 30. One end of the second spring 9 resists the bottom wall 520 of the fixing seat 5. A diameter of the second spring 9 is smaller than the diameter of the second spring 9 so that the second spring 9 may pass coaxially through the first spring 7.

The ring 91 is made of metal. The set of rolling elements 92 are steel ball-bearings.

The follower element 10 is substantially cylindrical in shape. Two latching portions 11 extend from one end of the follower element 10. Two notches 12 are defined between the latching portions 11. The latching portions 11 may be engaged into the cutouts 84 of the control member 8, and the extending walls 83 of the control member 8 may be received in the notches 12. Accordingly, the follower element 10 and the control member 8 are locked together. The other end of the follower element 10 includes two recesses 15 and two plane portions 16. A sectional configuration of each of the recesses 15 is an arcuate surface or slope surface, ellipse surface. The specific configuration of the recesses 15 depends on the desired opening angle of the cover 102. The follower element 10 has a stepped hole 13 defined in a central area thereof. A diameter of stepped hole 13 with the recesses 15 is larger than that of the stepped hole 13 opposite to the recess 15. Thus, the second spring 9 resists an end wall of the stepped hole 13. A wall of the stepped hole 13 has a containing groove 14 defined therein, for receiving the rolling elements 92.

The rotating element 20 is substantially cylindrical or disk-like in shape. One end of the rotating element 20 disposes two protrusions 24. Each of the protrusions 24 has a hemispherical surface. When the protrusions 24 are located on the plane portions 16 of the follower element 10, the hinge assembly 200 can be held in a steady state in any of a variety of selectable positions by the second spring 9. The rotating element 20 has an axis hole 22 defined in a central area thereof, and an inner thread 23 is defined in an inner wall of the rotating element 20. The rotating element 20 has two parallel engaging protrusions 21 disposed at an outside circumferential wall.

The shaft 30 includes a deformed shaft 33, a middle shaft 32 and a end shaft 31. A sectional configuration of the deformed shaft 33 is non-circular. A distal end of the deformed shaft 33 has an annular groove 331, and the retaining member 4 is locked into the annular groove 331. The middle shaft 32 is substantially cylindrical in shape, and the end shaft 31 forms a step 34 with the middle shaft 32. The end shaft 31 defines an outside thread 311 and includes a resisting end 312.

The sleeve 40 is a substantially hollow cylinder in shape and includes an open end and a half-closed end. Two long troughs 42 are defined in an inner wall of the sleeve 40. Accordingly, two sleeve blocks 43 are formed corresponding to the long troughs 42. The sleeve blocks 43 engage with the cover section 102 of the mobile phone 100. The engaging protrusions 21 of the rotating element 20 engage in the long troughs 42 so that the rotating element 20 and the sleeve 40 do not rotate relative to each other.

The washer 50 is O-shaped (i.e. disk shaped with a circular hole) and is fixed on the resisting end 312 of the shaft 30.

Figure 4:
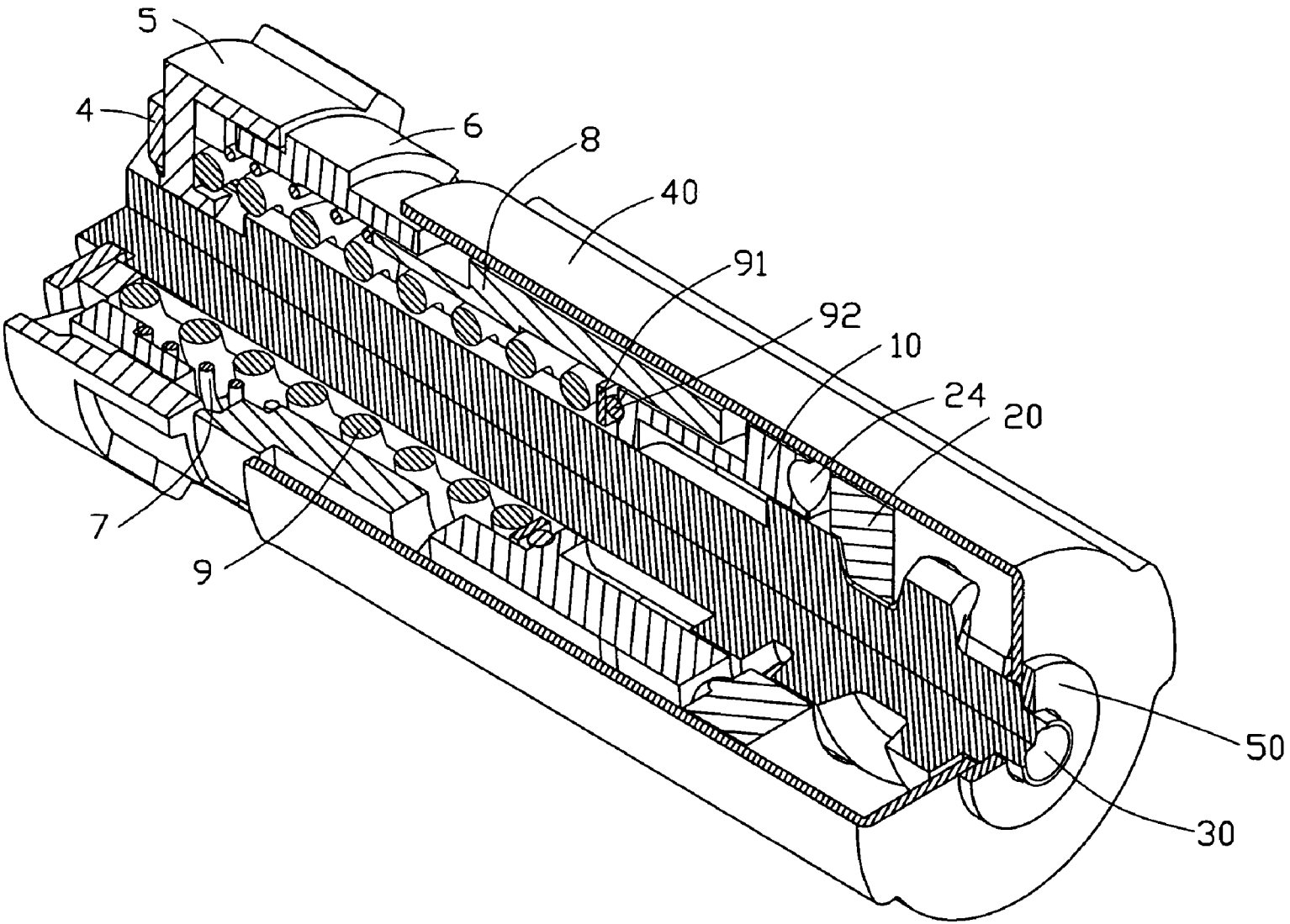
FIG. 4 is a cut-away view when the hinge assembly is assembled shown in FIGS. 2 and 3.

In assembly, referring to FIG. 4, the rotating element 20 is threaded onto the end shaft 31, with the outer thread 311 of the shaft 30 being engaged with the inner screw thread 23 of the rotating element 20. After the rotating element 20 is placed around the end shaft 31, the follower element 10 passes through the deformed shaft 33 of the shaft 30. The protrusions 24 of the rotating element 20 engage in the recesses 15 of the follower element 10. The rolling elements 92 are received into the containing groove 14 of the follower element 10. Then, the ring 91 covers the rolling elements 92 so as to prevent the rolling elements 92 from falling off/out. The second spring 9 is placed around the shaft 30, with one end of the second spring 9 resisting the ring 91. After that, the extending walls 83 of the locking member 8 engage with the notches 12 of the follower element 10, and the latching portion 11 of the follower element 10 are inserted into the recesses 84 of the locking member 8 so that the locking member 8 is locked with the follower element 10. The rolling elements 92 directly contact with the follower element 10 so that the sliding friction is turned into rotational friction between rolling elements 92 and the follower element 10. Accordingly, strain and friction are greatly reduced.

The first spring 7, the control member 6 are placed in order around the shaft 30. One end of the first spring 7 resists the stepped wall 81 of the locking member 8, the other end of the first spring 7 resists the latching wall 62 of the control member 6. The protruding posts 63 of the control member 6 engage in the latching grooves 82 of the locking member 8 so that the control member 6 is fixed together with the locking member 8. Then, the fixing seat 5 is placed around the shaft 30 so that an opposite end of the second spring 9 resists the bottom wall 520 of the fixing seat 5. The deformed shaft 33 of the shaft 30 partially extends out from the axis hole 540 of the fixing seat 5. The blocks 560 of the fixing seat 5 engage with the receiving grooves 61 of the control member 6, and the ribs 64 of the control member 6 engage with the openings 530 of the fixing seat 5, thereby limiting the rotation of the control member 6 relative to the fixing seat 5. The retaining member 4 is locked into the annular groove 331 of the deformed shaft 33. Accordingly, the above elements are fixed to the shaft 30.

The above assembled elements are received into the sleeve 40 with the rotating element 20. The engaging protrusions 21 of the rotating element 20 engage in the troughs 42 of the sleeve 40, and the resisting end 312 extends out from the half-closed end of the sleeve 40. The washer 50 is locked onto the resisting end 312 of the shaft 30. Accordingly, the hinge assembly 200 is thus completely assembled.

Once the individual hinge components are assembled as described above, the hinge assembly 200 provides a self-contained component that can be sold as an off-the-shelf component or directly incorporated into a mobile phone or other device during manufacture. If incorporated into a mobile phone during manufacture, the sleeve blocks 43 of the sleeve 40 can engage in a cavity (not shown) of the cover section 102 of the mobile phone 100, and the reversing groove 570 of the fixing seat 5 connects with the body section 104 of the mobile phone 100. When the cover section 102 of the mobile phone 100 is in a fully closed position, the second spring 9 has a predetermined pressure. The predetermined pressure of the second spring 9 is exerted on the follower element 10 and passed to the rotating element 20 so that the rotating element 20 has a rotation tendency relative to the outer screw thread 311 of the end shaft 31. However, the rotating element 20 is prevented from rotating by the control member 6.

In use, when the user wants to open the cover 102 of the mobile phone 100 automatically, he/she may push the latching walls 62 of the control member 6. The control member 6 moves axially so that the control member 6 moves the first spring 7 towards the rotating element 20. The first spring 7 accumulates elastic potential energy. When the latching walls 62 of the control member 6 break away from the blocks 560 of the fixing seat 5, the follower element 10, and the rotating element 20 rotates relative to the shaft 30 along the outer screw thread 311. The follower element 10 needs to overcome the resisting force form the second spring 9. However, the rolling elements 92 convert the sliding friction between the follower element 10 and the second spring 9 into rotating friction, and the abrasion between the second spring 9 and the follower element 10 is thus greatly reduced.

When the rotating element 20 rotates, the follower element 10, the locking member 8, the first spring 7 and the control member 6 are also brought to move and rotate. Furthermore, the rotating element 20 makes the sleeve 40 rotate so that the cover section 102 of the mobile phone 100 is opened. The rotating element 20 stops rotating when the cover section 102 of the mobile phone 100 is completely opened. The elastic potential energy of the first spring 7 then pushes the control member 6 in a reverse direction towards the fixing element 4. Accordingly, the latching walls 62 of the control member 6 are locked between the blocks 560 of the fixing seat 5.

When the cover section 102 of the mobile phone 100 is closed, the cover section 102 causes the sleeve 40 to rotate relative to the body section 104. The sleeve 40 further brings the rotating element 20 to rotate relative to the outer screw thread 311 of the end shaft 31. Because the control member 6 is locked into the blocks 560 of the fixing seat 5, the control member 6 cannot rotate relative to the fixing seat 5. Accordingly, the locking member 8 and the follower element 10 do not rotate relative to the fixing seat 5. Thus, the rotating element 20 rotates relative to the follower element 10. When the rotating element 20 rotates, the follower element 10 is pushed toward the fixing element 4. When the rotating element 20 rotates out from the recesses 14 of the follower element 10, the second spring 9 accumulates elastic potential energy. Whilst still exerting a force, the protrusions 24 of the rotating element 20 slide to an edge of the next recess 14 of the follower element 10. When this force is released, the rotating element 20 automatically slides into the recesses 15 of the follower element 10. Accordingly, the cover section 102 becomes closed relative to the body section 104 of the mobile phone 100.

The hinge assembly 200 may be opened manually. When the cover section 102 of the mobile phone 100 is opened, the cover section 102 causes the sleeve 40 to rotate relative to the body section 104. The sleeve 40 further brings the rotating element 20 to rotate relative to the outer screw thread 311 of the end shaft 31. Because the control member 6 is locked into the blocks 560 of the fixing seat 5, the control member 6 cannot rotate relative to the fixing seat 5. Accordingly, the locking member 8 and the follower element 10 do not rotate relative to the fixing seat 5. Thus, the rotating element 20 rotates relative to the follower element 10. When the rotating element 20 rotates, the follower element 10 is pushed toward the fixing element 4. When the rotating element 20 rotates out from the recesses 14 of the follower element 10, the protrusions 24 of the rotating element 20 stay on the plane portions 16 of the follower element 10. With no outside force acting on it, the hinge assembly 200 can be held in a steady state in any of a variety of selectable positions by the second spring 9. Accordingly, the cover section 102 becomes open relative to the body section 104 of the mobile phone 100.

In an alternative embodiment, the first spring 7 and the second spring 9 may be replaced by other elastic elements such as elastic sponges.

In an alternative embodiment, the locking member 8 may be omitted. Accordingly, the control member 6 directly contacts with the follower 300, and the first spring 7 and the second spring 9 directly resist the follower 300.

As described above, the present invention provides a hinge assembly 200 for use with various portable devices, beyond the mobile phone illustrated, and/or with other devices requiring a hinge assembly that selectably facilitates the fully open and fully closed positions.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

We claim:

1. A hinge assembly, comprising:

a fixing seat having at least one block;

a control member having at least one receiving groove, the at least one block portion being received in the at least one receiving groove;

a first spring providing on elastic force to the control member;

a follower element;

a rotating element, the rotating element including a rotating element hole having an inner circumferential wall, the inner circumferential wall defining an inner screw thread;

a second spring providing an elastic force to make the rotating element and the follower element resist each other, wherein one of the rotating element and the follower element includes a pair of protrusion having a hemispherical surface, the other of the rotating element and the follower element has a pair of recesses, each protrusion is releasably received in a corresponding one of the recesses; and a shaft, the fixing seat, the control member, the first spring, the follower element, the rotating element and the second spring being placed around the shaft, the shaft defining an outer screw thread, the outer screw thread engaging with the inner screw thread of the rotating element.

2. The hinge assembly as claimed in claim 1, further comprising a set of rolling elements, wherein the follower element has a containing groove, the rolling elements are received in the containing groove.

3. The hinge assembly as claimed in claim 2, further comprising a ring, wherein the ring covers the containing groove.

4. The hinge assembly as claimed in claim 1, further comprising a locking member,wherein the locking member non-rotatably connects with the control member and the follower element.

5. The hinge assembly as claimed in claim 4, wherein the first spring is disposed between the locking member and the control member.

6. The hinge assembly as claimed in claim 5, wherein the control member has at least one protruding post extending from one end, the locking member has at least one latching groove, the at least one protruding post is received in the at least one latching groove.

7. The hinge assembly as claimed in claim 6, wherein the locking member has a stepped wall adjacent to the latching groove, a diameter of the first spring is larger than that of an inner wall of the stepped wall, and smaller than that of an outer wall of the stepped wall, the first spring resists the stepped wall.

8. The hinge assembly as claimed in claim 7, wherein the locking member has at least one extending wall opposite to the stepped wall, the follower element has at least one notch, the at least one extending wall is received in a corresponding notch.

9. The hinge assembly as claimed in claim 1, wherein the shaft includes a deformed shaft portion, the fixing seat is fixed in the deformed shaft portion.

10. A hinge assembly of a foldable electronic device comprising a main body and a flip cover, the hinge assembly comprising:

a hinge shaft including an outer screw thread thereon;

a rotating element attached around the hinge shaft, the rotating element having an inner screw thread formed on an inner periphery thereof, the inner screw thread engaging with the outer screw thread, the rotating element being configured so as to be non-rotably connected to one of the main body and the flip cover;

a follower element attached around the hinge shaft, wherein one of the rotating element and the follower element includes a protrusion having a hemispherical surface, the other of the rotating element and the follower element has a substantially flat surface with a recess defined therein the protrusion selectively engages in the recess and with the flat surface when the rotating element rotates relative to the follower element;

a first elastic member attached around the hinge shaft and resisting the follower element;

a fixing seat attached around the hinge shaft and configured so as to be non-rotatably connected to the other of the main body and the flip cover;

a control member attached around the hinge shaft and fixed relative to the follower element along a circumferential direction of the rotating element, the control member being movable between a locked position where the control member is engaged with the fixing seat in a manner so as to prevent the control member from rotating relative to the fixing seat, and an unlocked position where the control member is released and is movable relative to the fixing seat; and a second elastic member attached around the hinge shaft and biasing the control member toward the fixing seat.

11. The hinge assembly as claimed in claim 10, further comprising a locking member, wherein the locking member non-rotatably connects with the control member and the follower element.

12. A foldable electronic device having at least two components hinged together by a hinge assembly, the hinge assembly comprising:

a fixing seat having at least one block, a control member having at least one receiving groove;

a first spring providing an elastic force to the control member;

a follower element having two recesses and two plane portions, the recesses and the plane portions being connected in an interleaving manner along a circumferential direction;

a rotating element having two protrusions, the rotating element including an axis hole having an inner circumferential wall, the inner circumferential wall defining an inner screw thread;

a second spring providing an elastic force to make the protrusions of the rotating element received in the recesses of the follower element and resist each other; and a shaft, the fixing seat, the control member, the first spring, the follower element, the rotating element and the second spring being placed around the shaft, the shaft defining an outer screw thread, the outer screw thread engaging with the inner screw thread of the rotating element.

13. The foldable electronic device as claimed in claim 12, wherein the hinge assembly further comprises a locking member, the locking member non-rotatably connects with the control member and the follower element.

14. The foldable electronic device as claimed in claim 13, wherein the first spring is disposed between the locking member and the control member.

15. The foldable electronic device as claimed in claim 14, wherein the control member has at least one protruding post extending from one end, the locking member has at least one latching groove, the at least one protruding post is received in the at least one latching groove.

16. The foldable electronic device as claimed in claim 15, wherein the locking member has a stepped wall adjacent to the latching groove, a diameter of the first spring is larger than that of an inner wall the stepped wall, and smaller than that of an outer wall of the stepped wall, the first spring resists the stepped wall.

17. The foldable electronic device as claimed in claim 16, wherein the locking member has at least one extending wall opposite to the stepped wall, the follower element has at least one notch, the at least one extending wall is received in a corresponding notch.

* * * * *